US011583035B2

(12) United States Patent
Dombrow et al.

(10) Patent No.: US 11,583,035 B2
(45) **Date of Patent: *Feb. 21, 2023**

(54) ARTICLE OF FOOTWEAR WITH DYNAMIC TENSIONING SYSTEM

(71) Applicant: Under Armour, Inc., Baltimore, MD (US)

(72) Inventors: David Dombrow, Baltimore, MD (US); Justin Howe, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 209 days.

This patent is subject to a terminal disclaimer.

(21) Appl. No.: 16/812,627

(22) Filed: Mar. 9, 2020

(65) Prior Publication Data

US 2020/0205522 A1 Jul. 2, 2020

Related U.S. Application Data

(63) Continuation of application No. 15/793,234, filed on Oct. 25, 2017, now Pat. No. 10,582,741.

(60) Provisional application No. 62/412,424, filed on Oct. 25, 2016.

(51) Int. Cl.

| | |
|---|---|
| ***A43C 1/04*** | (2006.01) |
| ***A43C 11/22*** | (2006.01) |
| ***A43B 1/04*** | (2022.01) |

(52) U.S. Cl.

CPC ..... *A43C 1/04* (2013.01); *A43B 1/04* (2013.01); *A43C 11/22* (2013.01)

(58) Field of Classification Search

CPC ..... A43C 1/04; A43C 11/22; A43B 1/04

See application file for complete search history.

(56) References Cited

U.S. PATENT DOCUMENTS

| | | | | |
|---|---|---|---|---|
| 2,152,860 A | | 5/1879 | Noack | |
| 4,507,878 A | | 4/1985 | Semouha | |
| 4,870,761 A | * | 10/1989 | Tracy | A43C 1/04 24/712 |

(Continued)

FOREIGN PATENT DOCUMENTS

| | | | |
|---|---|---|---|
| EP | 2255688 | A1 | 12/2010 |
| JP | 2008061901 | A | 3/2008 |

(Continued)

OTHER PUBLICATIONS

PCT International Search Report and the Written Opinion for PCT/US2017/058236, dated Mar. 23, 2018, 6 pages.

*Primary Examiner* — Jila M Mohandesi

(74) *Attorney, Agent, or Firm* — Edell, Shapiro & Finnan, LLC

(57) ABSTRACT

An article of footwear includes a fastening system including a guide element and a carriage member slidably coupled to the guide element. A lacing element is coupled to the carriage member such that the position of the lacing element changes as the carriage member moves along the guide element. In an embodiment, the footwear includes a lateral side rail and a medial side rail, each rail including one or more carriage members selectively movable along the rail for a predetermined distance. The lacing element extends repeatedly from the lateral side to the medial side, being captured by the carriage members. In operation, the carriage members move along the rail, adapting the positioning of the lacing element.

19 Claims, 12 Drawing Sheets

(56) References Cited

U.S. PATENT DOCUMENTS

| | | | | |
|---|---|---|---|---|
| 5,371,957 | A * | 12/1994 | Gaudio | A43B 11/00 36/50.1 |
| D441,522 | S | 5/2001 | Matis et al. | |
| 8,065,818 | B2 * | 11/2011 | Greene | A43B 9/00 12/142 E |
| 8,069,588 | B2 | 12/2011 | Rivas et al. | |
| 9,615,624 | B2 | 4/2017 | Kilgore et al. | |
| 2006/0000116 | A1 | 1/2006 | Brewer | |
| 2007/0180730 | A1 * | 8/2007 | Greene | A43B 13/04 36/3 R |
| 2009/0172929 | A1 | 7/2009 | Jong | |
| 2012/0110870 | A1 * | 5/2012 | Haouari | A43B 3/24 36/83 |
| 2012/0192461 | A1 | 8/2012 | Backus | |
| 2013/0180132 | A1 | 7/2013 | Settele | |
| 2014/0259761 | A1 | 9/2014 | Linth | |
| 2014/0325873 | A1 * | 11/2014 | Linth | A43C 11/004 36/50.1 |
| 2016/0206047 | A1 | 7/2016 | Hammerslag et al. | |

FOREIGN PATENT DOCUMENTS

| | | | |
|---|---|---|---|
| TW | 201221077 | A | 6/2012 |
| WO | 9709894 | A1 | 3/1997 |
| WO | 9709895 | A1 | 3/1997 |
| WO | 2011045645 | A1 | 4/2011 |

* cited by examiner

ARTICLE OF FOOTWEAR WITH DYNAMIC TENSIONING SYSTEM

CROSS-REFERENCE TO RELATED APPLICATIONS

This application is a continuation of U.S. patent application Ser. No. 15/793,234, entitled "Article of Footwear with Dynamic Tensioning System", filed Oct. 25, 2017, which claims priority under 35 U.S.C. 119(e) to U.S. Provisional Patent Application Ser. No. 62/412,424, entitled "Article of Footwear with Dynamic Tensioning System", filed Oct. 25, 2016, the disclosures of which are incorporated herein by reference in their entireties for all purposes.

FIELD OF THE INVENTION

The present invention relates to an article of footwear with a dynamic tensioning system.

BACKGROUND OF THE INVENTION

Footwear, particularly athletic footwear, are worn in a variety of activities including running, walking, hiking, team and individual sports, and any other activity where the protection and support of human feet is desired. In one configuration, an article of footwear includes an upper that forms a cavity in which a user places his or her foot. The human foot has various sections including the forefoot, midfoot, and heel, where the midfoot includes the arch of the foot. Every foot differs in both shape and size. While articles of footwear are sold in various sizes, the sizes are generalizations for only the size of the foot that the article of footwear may fit, and these sizes fail to take into consideration the varying shapes between different feet having the same size. Because conventional articles of footwear are incapable of accommodating varying shapes of feet, an article of footwear is limited to the number of people that find that article of footwear comfortable.

It would be desirable to provide an article of footwear with adaptable or repositionable eyelets.

SUMMARY OF THE INVENTION

An article of footwear includes a dynamic tensioning or fastening system. The fastening system includes a guide element and a carriage members slidably coupled to the guide element. A lacing element is coupled to the guide element. In an embodiment, the footwear includes a guide element including a guide rail that is disposed on a lateral side and/or a medial side of an upper of the article of footwear. A plurality of carriage members are provided which are selectively movable along the guide rail for a predetermined distance. A lacing element extends from the lateral to medial side, being captured by selected carriage members. In operation, the carriages move along the rail, adapting the positioning of the fastening element.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

BRIEF DESCRIPTION OF THE SEVERAL VIEWS OF THE DRAWING

Like reference numerals have been used to identify like elements throughout this disclosure.

DETAILED DESCRIPTION OF THE INVENTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be per-formed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Figure 1A:
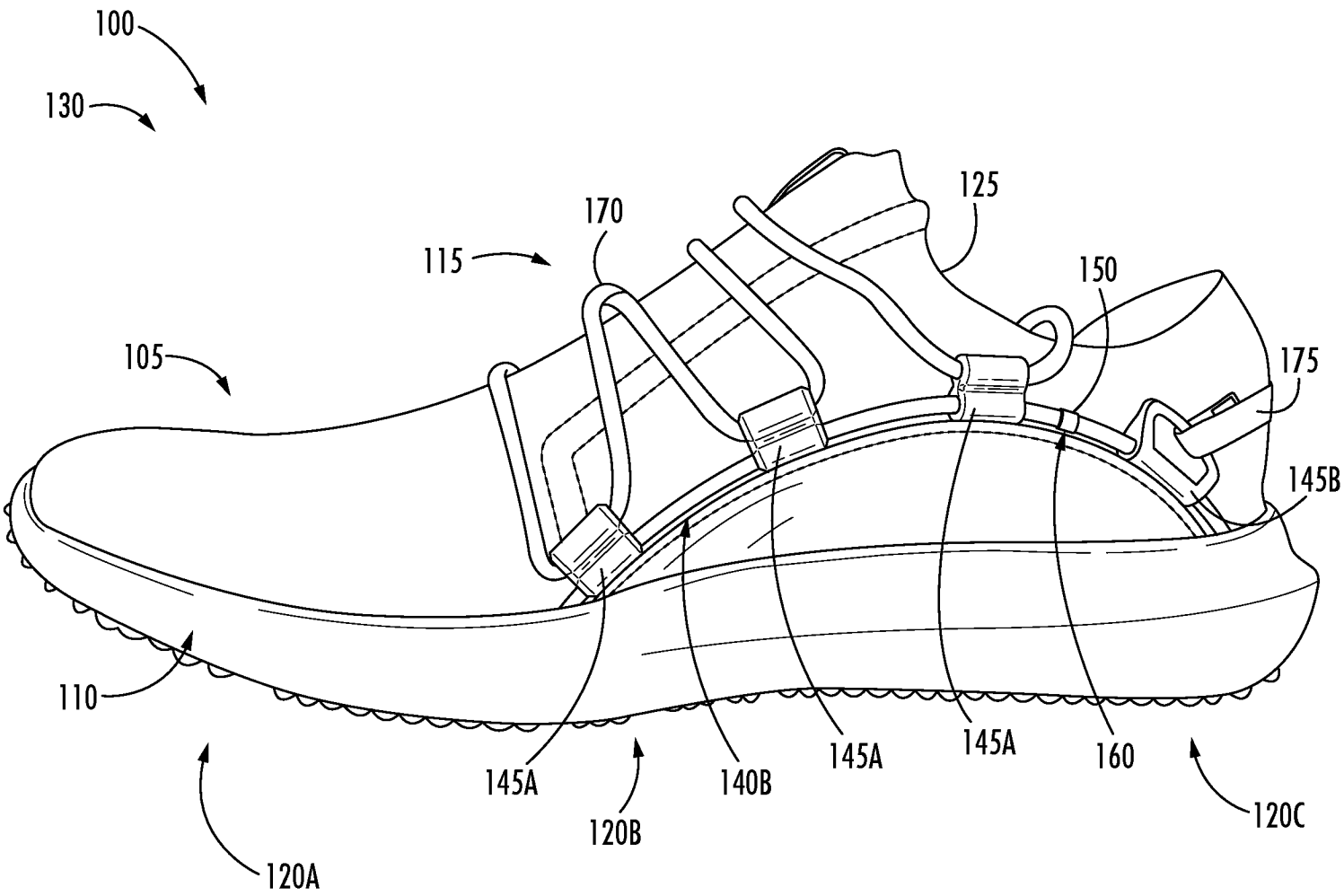
FIG. 1A illustrates a side view in elevation of an article of footwear in accordance with an embodiment, showing a medial shoe side.
Figure 1B:
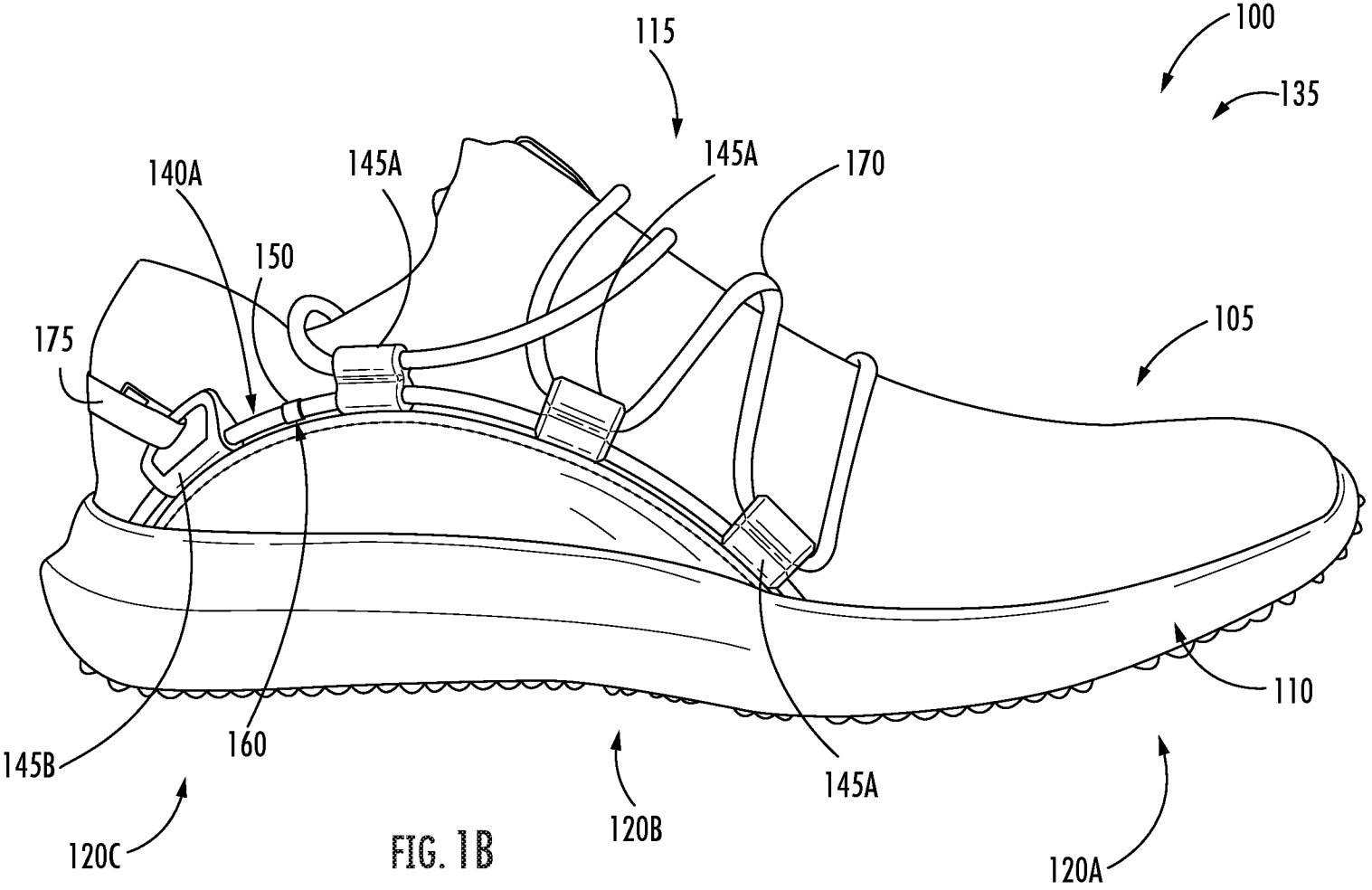
FIG. 1B illustrates a side view in elevation of an article of footwear in accordance with the embodiment illustrated in FIG. 1A, showing a lateral shoe side.
Figure 2:
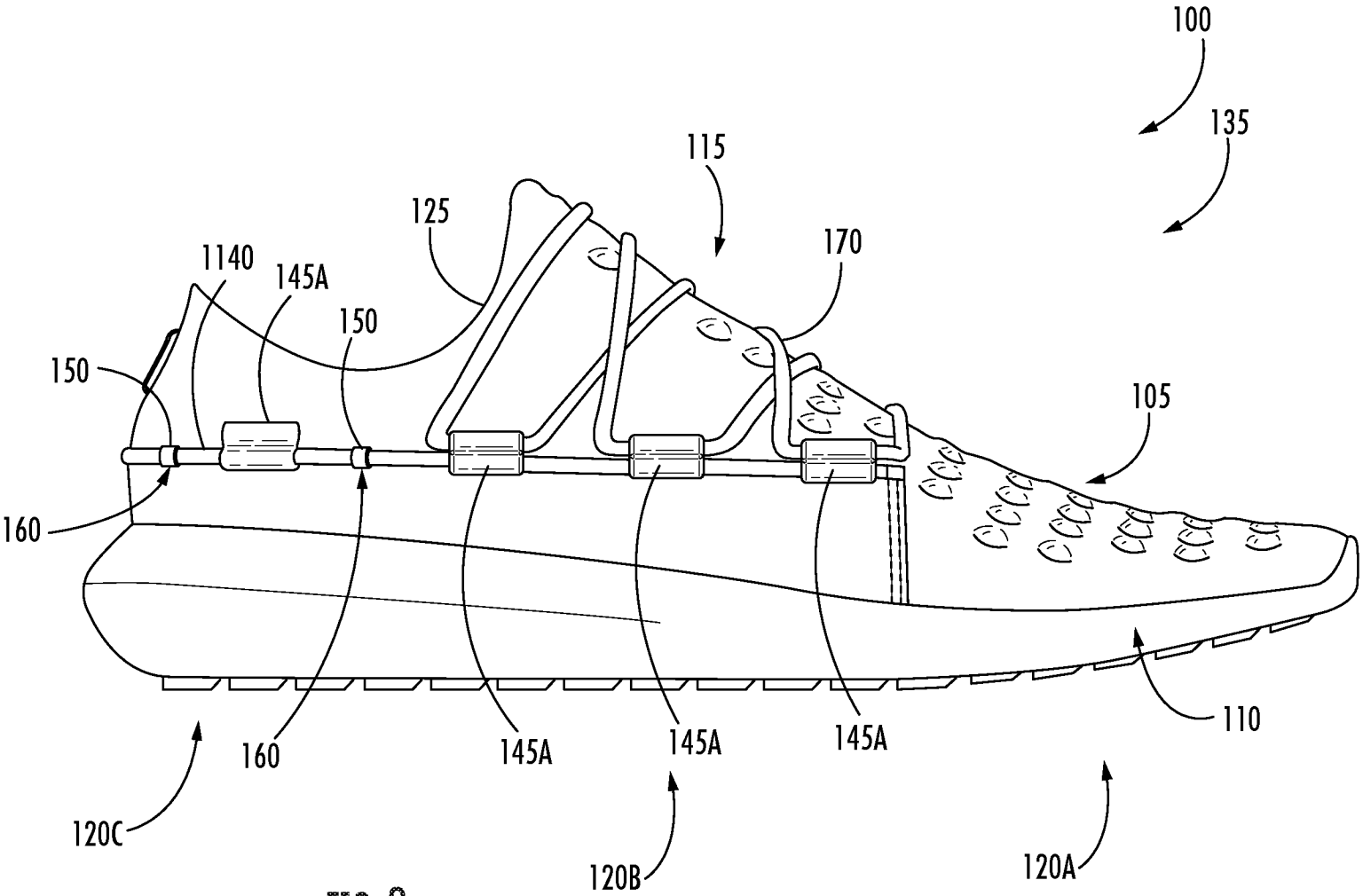
FIG. 2 illustrates a side view in elevation of an article of footwear in accordance with another embodiment, showing a lateral shoe side.

Referring to FIGS. 1-3, an article of footwear or shoe 100 includes an upper 105, a sole structure 110, and a dynamic tensioning or fastening system 115. The article of footwear 100 further defines a forefoot or forward region 120A, a midfoot or intermediate region 120B, and a heel or rearward region 120C, as well as a medial side 130 (along the medial side of the foot) and a lateral side 135 (along the lateral side of the foot). The upper 105 includes a heel at a rear or heel end, a lateral quarter, a medial quarter, a vamp, and a toe cage at a front or toe end. The upper 105 and sole 110 cooperate to define a foot cavity adapted to receive a human foot. An opening defined by a collar 125 provides access to the foot cavity, enabling a foot to enter and be disposed within the cavity. While the upper 105 depicted in the figures includes a continuous material portion extending between the medial side 130 and lateral side 135 of the upper, the invention is not limited to such configuration for the upper. In alternative embodiments, the upper can be formed such that each of the lateral and medial sides extends upward to top portions that terminate at an upward top portion edge extending longitudinally along the upper from a location proximate the toe cage to a location proximate the collar, and where the upper further includes a material portion or tongue that is located between (and extends partially underneath) the upward top portion edges.

The upper 105 may be constructed from various materials that are configured to conform and contour to a foot that is placed within the article of footwear 100. In some embodiments, various materials may be used to construct the upper 105, including, but not limited to, leather, synthetic leather, rubber, textile fabrics (e.g., breathable fabrics, mesh fabrics, synthetic fabrics), etc. A variety of materials can be used to form the upper including, without limitation, thermoplastic materials such as polyurethanes (i.e., thermoplastic polyurethane or TPU), ethylene vinyl acetates, polyamides (e.g., low melt nylons), and polyesters (e.g., low melt polyester). The materials forming the upper may be configured to have a predetermined degree of stretchability and compressibility, either throughout the upper or at selected upper locations. The materials for the upper 105 further may be generally lightweight and flexible, and may be configured to provide comfort to the user and provide other desirable features. Moreover, the materials used on the upper 105 may be configured to have desirable aesthetics and functional features that incorporate durability, flexibility, air permeability and/or other types of desirable properties to the upper. As described in further detail herein, the upper 105 can be formed via any suitable process (e.g., knitting, weaving, thermoforming, etc.).

The sole structure 110 comprises a durable, wear-resistant component configured to provide cushioning as the shoe 100 impacts the ground. In certain embodiments, the sole structure 110 may include a midsole and an outsole. In additional embodiments, the sole structure 110 can further include an insole that is disposed between the midsole and the upper 105 when the shoe 100 is assembled. The sole structure 110 may be formed of a single material or may be formed of a plurality of materials. In example embodiments in which the sole structure includes a midsole and an outsole, the midsole may be formed of one or more materials including, without limitation, ethylene vinyl acetate (EVA), an EVA blended with one or more of an EVA modifier, a polyolefin block copolymer, and a triblock copolymer, and a polyether block amide. The outsole may be formed of one or more materials including, without limitation, elastomers (e.g., thermoplastic polyurethane), siloxanes, natural rubber, and synthetic rubber.

The dynamic fastening system 115 operates in cooperation with a lacing element 170 to provide a selective cinching (e.g., tightening or loosening) of the upper around the foot of the wearer of the shoe 100. The dynamic fastening system 115 includes a guide element 140 (also referred to as a guide rail) and at least one carriage member 145A, 145B movably coupled to the guide element 140. The guide element 140 directs the movement of the carriage members 145A, 145B along a predefined pathway, where the guide element functions as a rail along which carriage members can be moved to different positions along portions of the upper. In an embodiment, the guide element 140 is an elongated rail running longitudinally or lengthwise along the upper 105 (i.e., in a direction extending between the heel end and the toe end of the upper). The guide element 140 further extends along one or both sides (lateral and medial sides) of the upper at a location above the sole structure 110 and below the collar 125. In particular, the guide element 140 extends along a lateral and/or medial side which is below a top or connecting portion of the upper that extends from the toe cage to the collar 125 of the upper 105, where the top or connecting portion is defined as the portion of the upper that extends or spans between the lateral and medial sides of the upper. To state in another manner, each of the lateral and medial sides of the upper (upon which a guide element can be provided) extend along a plane that is generally orthogonal to a ground-engaging surface of the sole structure 110 (i.e., the surface of the sole structure that engages with the ground or other surface upon which the shoe is placed during use). To further state in another manner, the lateral and medial sides of the upper extend in planes that are generally parallel to each other, while the top or connecting portion of the upper extends in a plane that is transverse (e.g., generally orthogonal) to the planes in which the lateral and medial sides extend. Further still, the guide element 140 is located along the upper at side locations (e.g., lateral and/or medial side locations) below where typical or conventional eyelets are provided on an upper for receiving a lacing element.

The guide element 140 may be formed of any material possessing sufficient rigidity to guide the carriage members 145A, 145B, as well as a sufficient coefficient of friction sufficient to permit the carriage members 145A, 145B to slide along the guide element. In the embodiment illustrated in FIGS. 1A, 1B, 2, 3A, 3B, 4A, and 4B, the guide element 140 includes an elongated cylindrically shaped member or solid cylinder having a generally circular cross-sectional dimension (e.g., a cylindrical tube).

By way of example, the tube forming the guide element 140 comprises foam piping having a diameter of approximately 2-6 mm (e.g., 3.175 mm). The guide element 140 may be secured to the upper 105 utilizing any suitable methods (sewing, adhesive, welding, etc.). Specifically, the guide element 140 may include a foam core and a fabric sheath surrounding the core, where the fabric sheath provides the requisite coefficient of friction to enable sliding of the carriage members 145A, 145B. For example, the guide rail and each carriage member are configured to cooperate such that each carriage member is retained by a frictional force that maintains the carriage member at a selected position along the guard rail until a sufficient force is applied to the carriage member to overcome the frictional force so as to move the carriage member along the guide rail. The fabric sheath can be sewn or secured in any other suitable manner (e.g., adhesively bonded) to the upper 105 to secure the guide element 140 to the upper 105.

In a further embodiment, the guide element 140 comprises a tensile strand secured to the exterior surface of the upper. The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament). The term strand further includes tailored or printed fibers.

The guide element 140 may be further secured to the upper utilizing a securing strand. In general, the diameter of the strand forming the guide element 140 is greater than the strand forming the securing strand (e.g., four times greater). In another embodiment, the guide element is secured at selected locations to the upper via webbing. Referring to the figures, the webbing 150 is placed at selected longitudinal locations along the length of the guide element. The webbing 150, in addition to securing the guide element 140 to the upper 105, may further act as stops to the carriage members 145A, 145B (discussed in greater detail below).

In the embodiment illustrated in FIGS. 1A and 1B, the footwear 100 includes a medial guide element 140A disposed along the footwear medial side 130 and a lateral guide element 140B disposed along the footwear lateral side 135. Each guide element 140A, 140B is generally linear and flexible so as to be curved in its securing to the footwear side, where each guide element follows a generally arcuate travel path along its respective footwear side. The guide elements 140A, 140B begin proximate the heel cup at the bite line (i.e., where the sole 110 connects to the upper 115, such that one or both ends of each guide element extends from the sole), extend forward toward the toe cage, and terminate proximate the vamp of the shoe 100. Each guide element 140A, 140B further remains below any portion of the collar 125 along the travel path of the guide element. Thus, the embodiment illustrated in FIGS. 1A and 1B includes a guide element for each side (medial and lateral sides) of the upper.

In other embodiments, an upper can include a single, continuous guide element that extends along sides of the upper and spans both the lateral and medial sides. For example, referring to the embodiment illustrated in FIG. 2, the upper 105 includes a guide element 1140 that spans both sides of the shoe 100 as a single continuous member. Specifically, the guide element 1140 begins proximate the vamp at a location intermediate to or between the sole structure 110 and the collar 125. The guide element 1140 extends continuously from the forward region 120A to the rearward region 120C on the medial side 130 of the upper 105, wraps around the heel cup, and then extends from the rearward region 120C to the forward region 120A on the lateral side 135 of the upper 105. As shown, the guide element 1140 is generally horizontal along its travel path.

Figure 5:
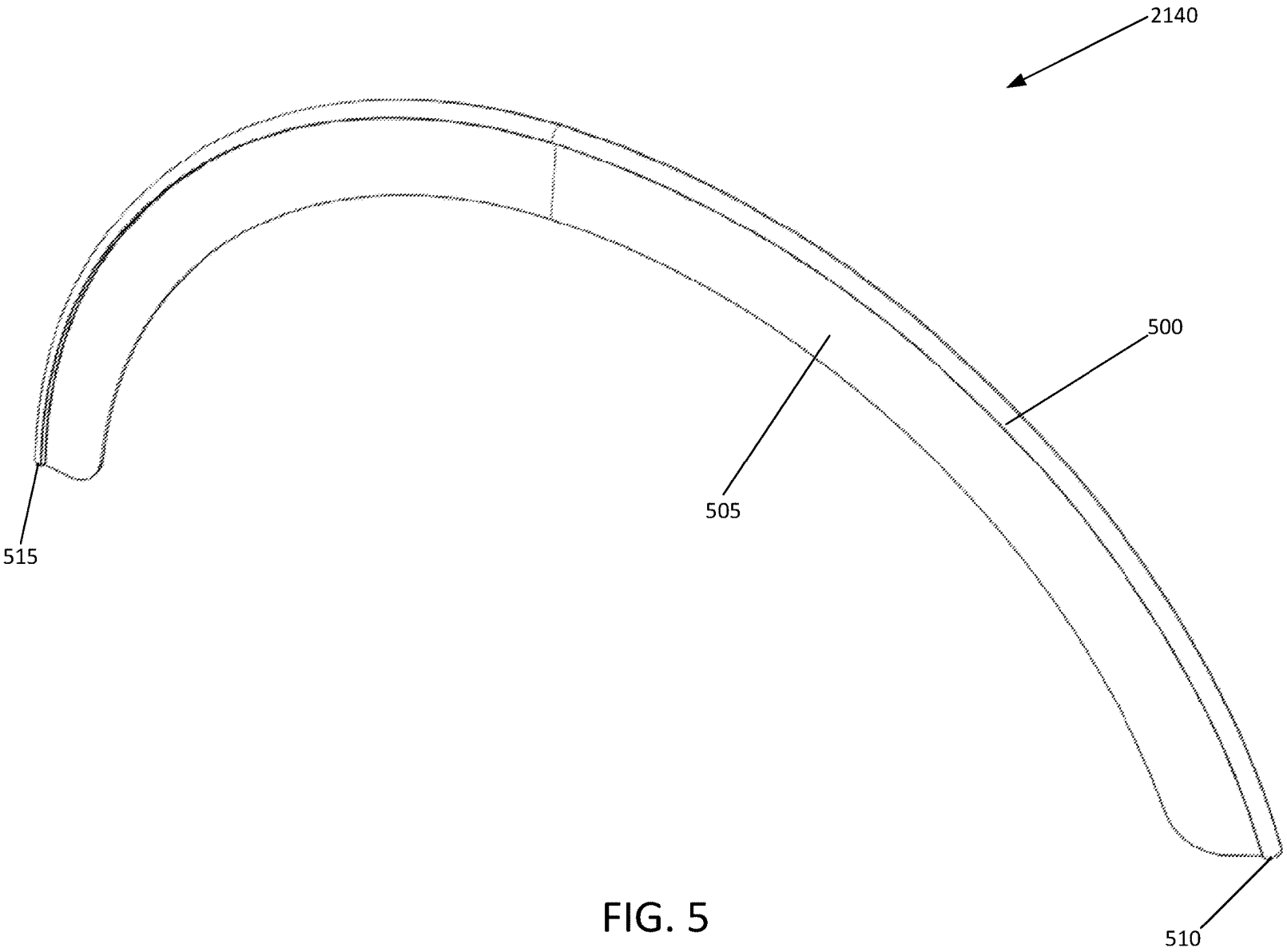
FIG. 5 illustrates a perspective view collar of an embodiment of the guide element 140 illustrated in FIGS. 1A and 1B.

In another embodiment illustrated in FIG. 5, the guide element 2140 includes a generally linear and generally arcuate travel path, where the guide element 2140 includes a guide portion 500 and a planar portion 505. The guide element 2140 illustrated in FIG. 5 may be disposed on either or both the medial and lateral sides 130, 135 of the shoe 100. The guide element 2140 further includes a first end 510 and a second end 515, where both the guide portion 500 and the planar portion 505 extend from the first end 510 to the second end 515. The guide portion 500 may be coupled to the planar portion 505, where the guide portion 500 contains a semicircular cross section forming a half cylinder spanning from the first end 510 to the second end 515 of the guide element 2140. Thus, the guide portion 500 and the planar portion 505 of the guide element 2140 has a generally mushroom-shaped cross section (i.e., generally T-shaped where the top portion of the T is rounded).

Each of the guide elements 140, 1140 and 2140 as described herein can be constructed of similar materials and can function in a similar manner to facilitate securing and movement of carriage members along the guide elements so as to selectively control positioning of the guide elements when cinching a lacing element through the guide elements as described herein.

Referring again to the embodiment in FIGS. 1A and 1B, the dynamic fastening system 115 includes at least one first carriage member 145A and at least one second carriage member 145B, where both the first and second carriage members 145A, 145B are movably coupled to the guide element 140. More specifically, the first and second carriage members 145A, 145B are operable to slidingly couple to guide element 140.

Figure 3A:
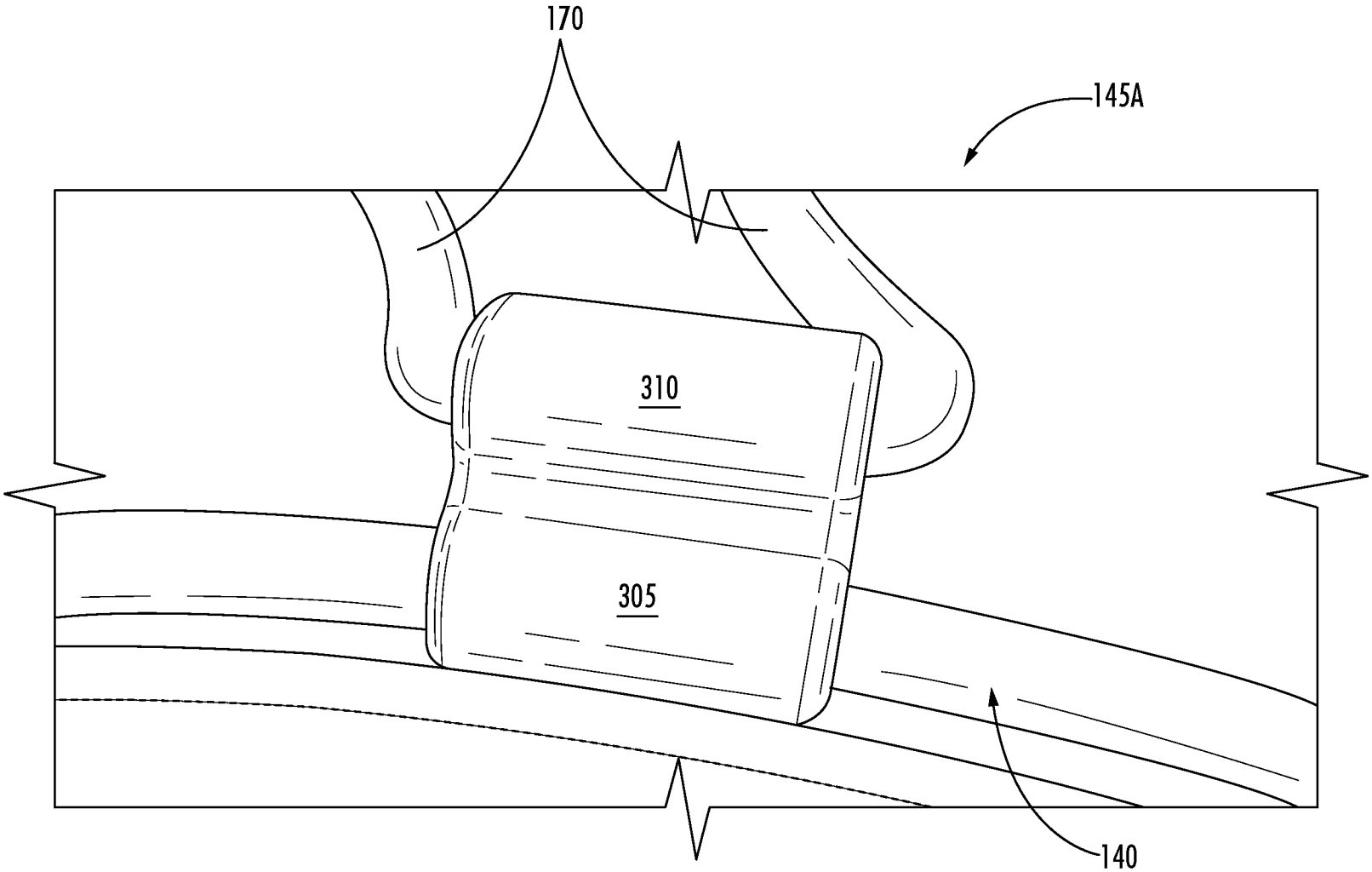
FIG. 3A illustrates a close-up side view of an embodiment of a first carriage member illustrated in FIGS. 1A, 1B, and 2.
Figure 3B:
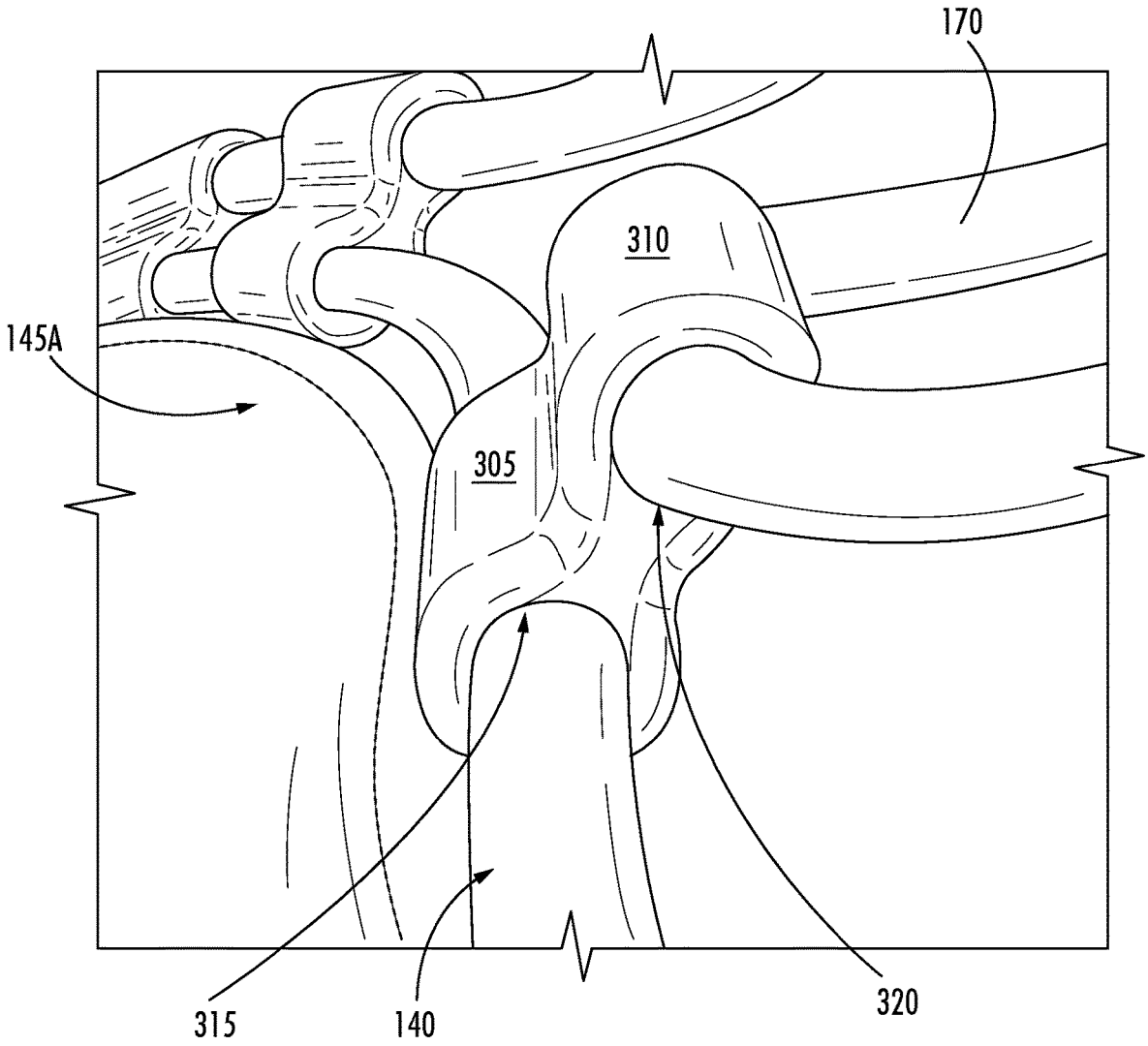
FIG. 3B illustrates a perspective view of the first carriage member illustrated in FIG. 3A.

As illustrated in the embodiment of FIGS. 3A and 3B, each first carriage member 145A includes a guide-element-receiving portion 305 and lacing-element-receiving portion 310. The embodiment of the first carriage member 145A illustrated in FIGS. 3A and 3B is configured to slide along the guide element 140 illustrated in FIGS. 1A and 1B (and also the guide element 1140 described in FIG. 2), where the guide-element-receiving portion 305 slidingly couples the first carriage member 145A to either of the guide elements 140A, 140B disposed on the upper 105. The guide-element-receiving portion 305 defines an aperture 315 that receives a portion of a guide element 140A, 140B and through which the guide element extends. In an embodiment, the guide-element-receiving portion 305 is annular, defining a generally cylindrical aperture at least partially surrounding a portion of a guide element 140A, 140B. More specifically, the guide-element-receiving portion 305 may be a generally C-shaped or semicircular clip mounted on one of the guide elements 140A, 140B such that it glides or slides along one of the guide elements 140A, 140B. The clip is sufficiently resilient to hold the first carriage member 145A in a desired position along either of the guide elements 140A, 140B (via friction) but to also permit movement of the first carriage member 145A when sufficient force is applied thereto. Similarly, the lacing element receiving portion 310 defines an aperture 320 that receives a portion of a lacing element 170 and through which the lacing element extends. In an embodiment, the lacing-element-receiving portion 310 is annular, defining a generally cylindrical aperture at least partially surrounding a portion of the lacing element 170.

Figure 6A:
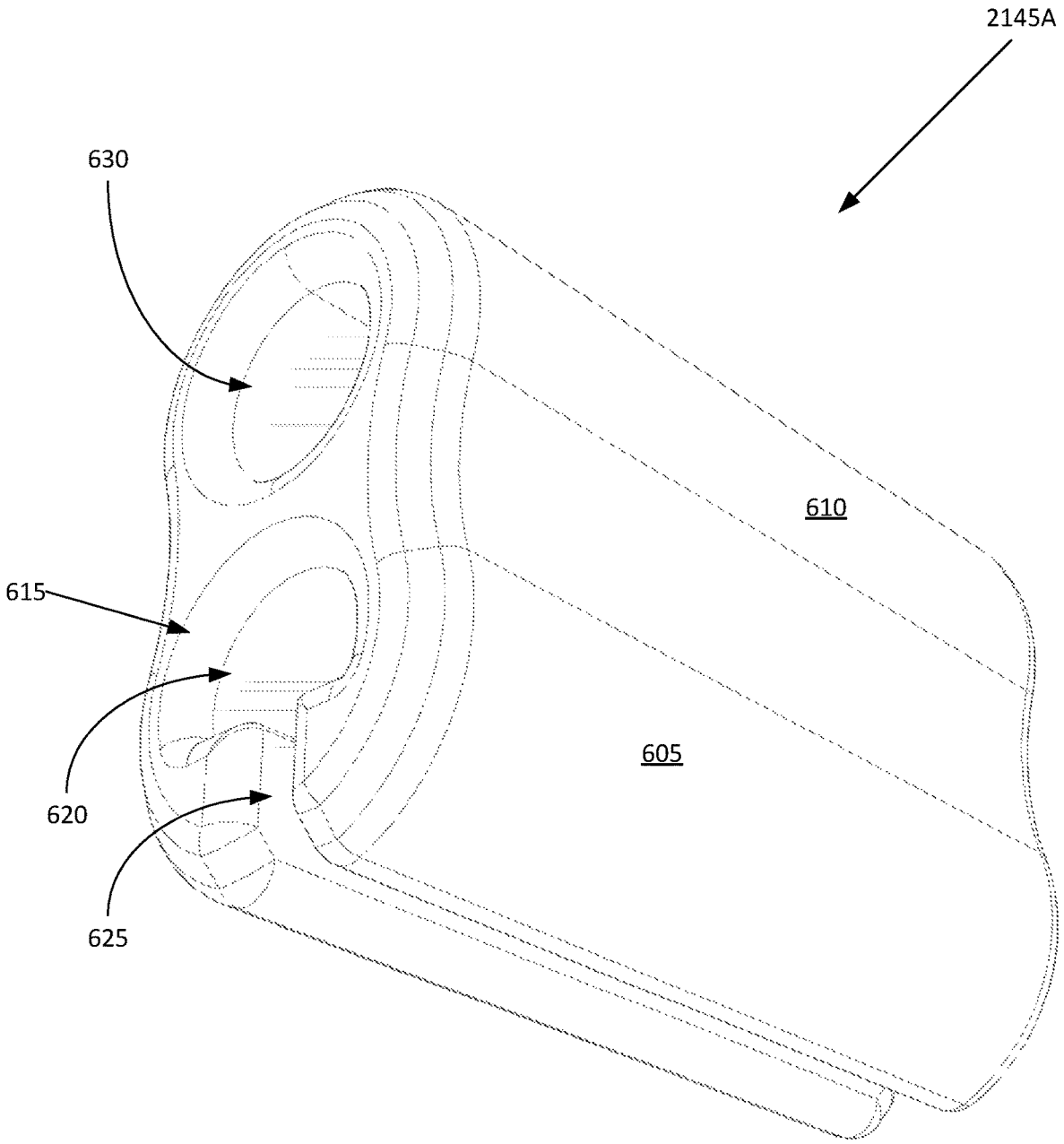
FIG. 6A illustrates a perspective side view of a second embodiment of the first carriage member illustrated in FIGS. 1A, 1B, and 2.
Figure 6B:
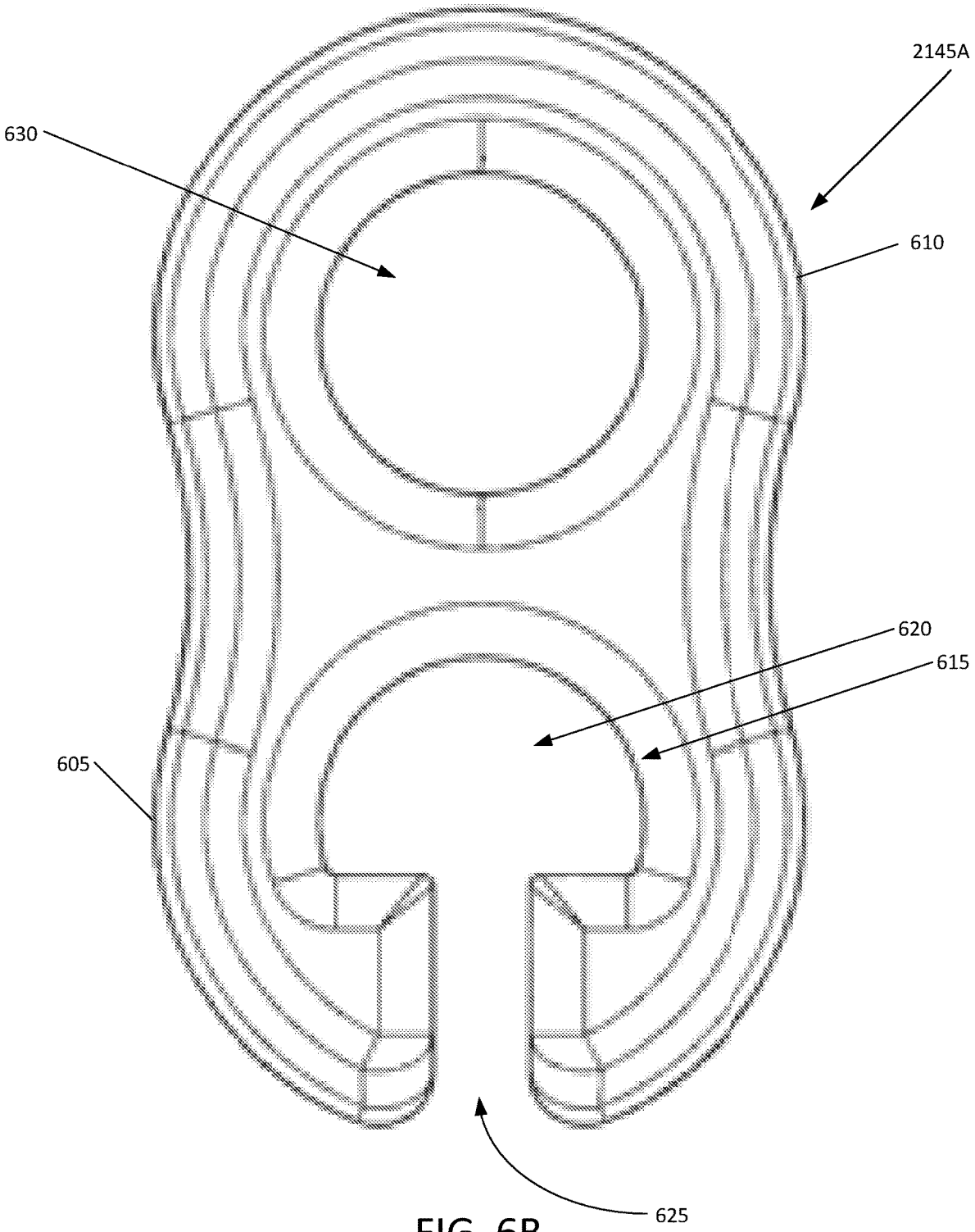
FIG. 6B illustrates an end view of the second embodiment of the first carriage member illustrated in FIG. 6A.

As illustrated in the embodiment of FIGS. 6A and 6B, another embodiment of the first carriage member 2145A also includes a guide-element-receiving portion 605 and lacing-element-receiving portion 610. The embodiment of the first carriage member 2145A illustrated in FIGS. 6A and 6B is configured to slide along the embodiment of the guide element 2140 illustrated in FIG. 5, where the guide-element-receiving portion 605 slidingly couples the first carriage member 145A to the guide element 2140. In the illustrated embodiment, the guide-element-receiving portion 605 defines an aperture 615 with a half cylindrical portion 620 and a slot portion 625. The half cylindrical portion 620 is configured to receive the guide portion 500 of the guide element 2140 of FIG. 5, while the slot portion 625 is configured to receive the planar portion 505 of the guide element 2140 of FIG. 5. Because the guide portion 500 of the guide element 2140 is wider than the planar portion 505 of the guide element 2140 and the slot portion 625 of the guide-element-receiving portion 605, the first carriage member 2145A is configured to slide along the guide element 2140 without being pulled off of the guide element 2140. In addition, the guide-element-receiving portion 605 is sized to hold the first carriage member 2145A in a desired position along the embodiment of the guide element 2140 illustrated in FIG. 5 (via friction) but permit movement of the first carriage member 2145A when sufficient force is applied thereto. In other words, the half cylindrical portion 620 and the slot portion 625 of the aperture 615 are sized and shaped to frictionally slide along the guide element 2140. The lacing-element-receiving portion 610 defines an aperture 620 through which lacing element 170 passes. In an embodiment, the lacing-element-receiving portion 610 is annular, defining a generally cylindrical aperture surrounding the lacing element 170.

Figure 4A:
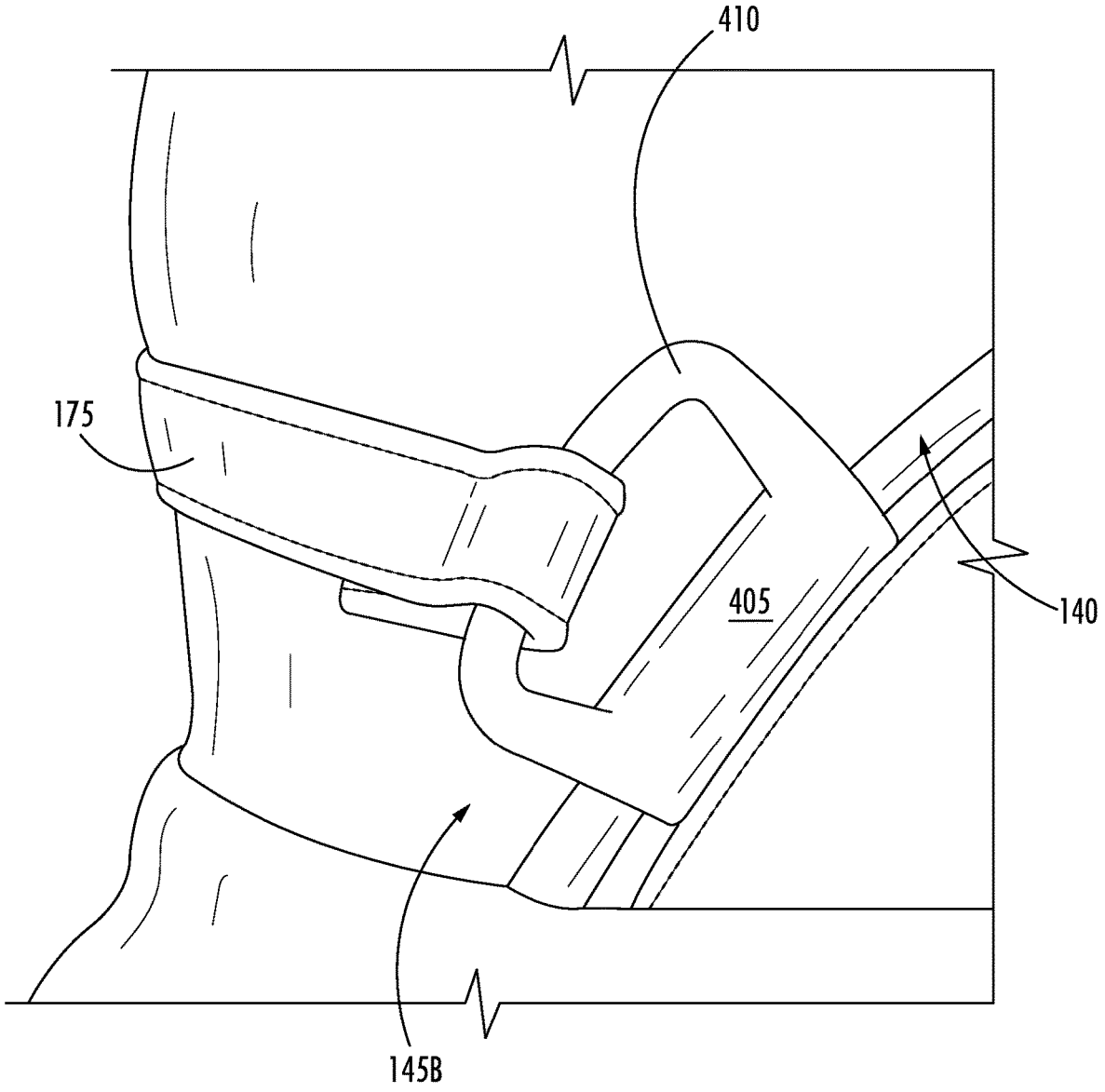
FIG. 4A illustrates a close-up side view of an embodiment of a second carriage member illustrated in FIGS. 1A and 1B.
Figure 4B:
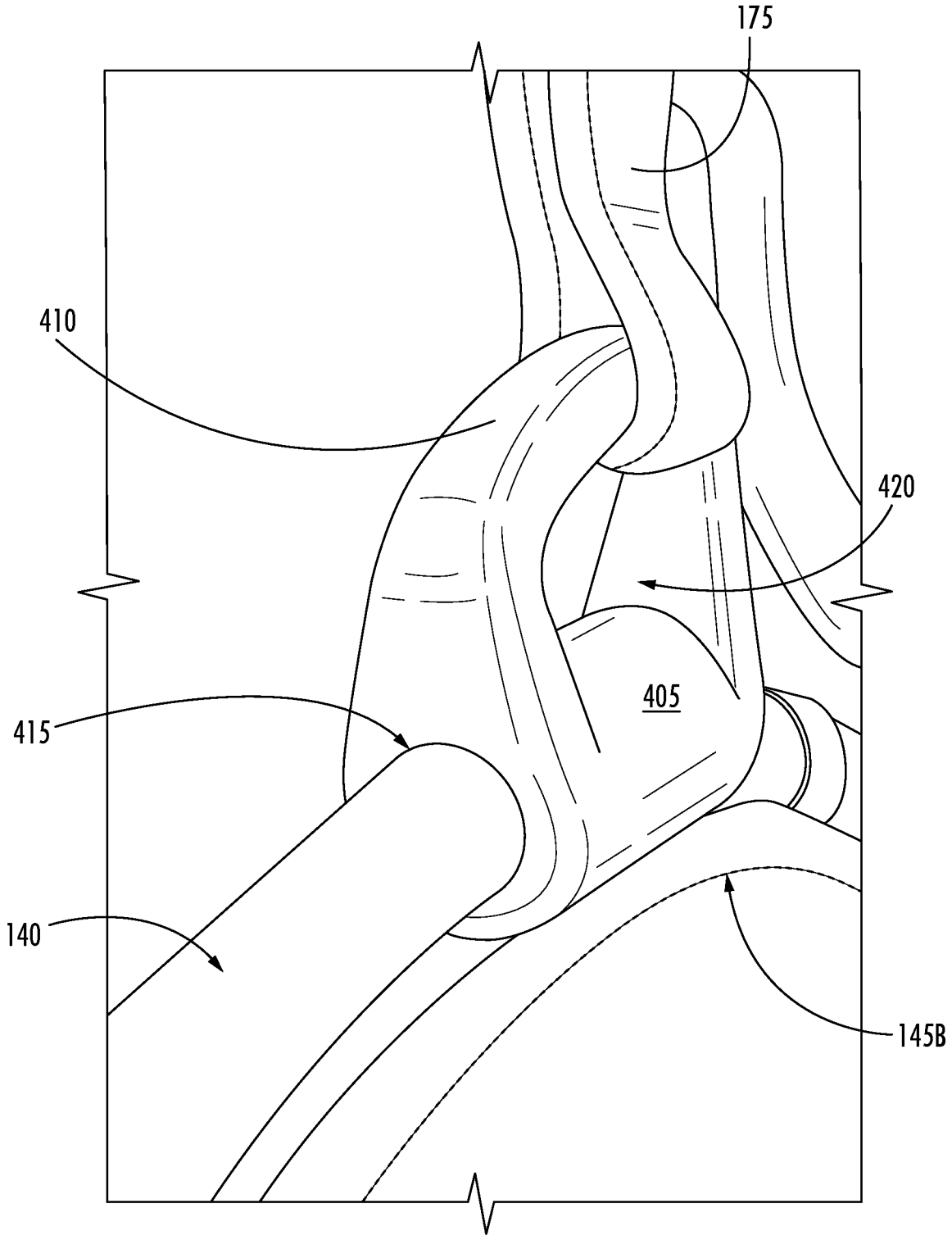
FIG. 4B illustrates a perspective view of the second carriage member illustrated in FIG. 4A.

As illustrated in the embodiment of FIGS. 4A and 4B, each second carriage member 145B includes a guide-element-receiving portion 405 and securing-strap-receiving portion 410. The embodiment of the second carriage member 145B illustrated in FIGS. 4A and 4B is configured to slide along the embodiment of the guide element 140 illustrated in FIGS. 1A and 1B (and the guide element 1140 illustrated in FIG. 2), where the guide-element-receiving portion 405 slidingly couples the second carriage member 145B to the embodiment of the guide elements 140A, 140B illustrated in FIGS. 1A and 1B. Similar to the first carriage member 145A illustrated in FIGS. 3A and 3B, the guide-element-receiving portion 405 of the second carriage member 145B defines an aperture 415 to receive a portion of the guide elements 140A, 140B and through which a portion of the guide elements extend. In an embodiment, the guide-element-receiving portion 405 is annular, defining a generally cylindrical aperture surrounding one of the guide elements 140A, 140B. More specifically, the guide-element-receiving portion 305 may be a generally C-shaped or semicircular clip mounted on one of the guide elements 140A, 140B such that it glides or slides along one of the guide elements 140A, 140B. The clip is sufficiently resilient to hold the second carriage member 145B in a desired position along either of the guide elements 140A, 140B (via friction) but permit movement of the second carriage member 145B when sufficient force is applied thereto.

The securing-strap-receiving portion 410 is formed as an arched member or bar spaced from the guide-element-receiving portion 405 such that the securing-strap-receiving portion 410 and the guide-element-receiving portion 405 collectively form an opening 420. A securing strap 175 may pass through the opening 420 such that and end of the securing strap 175 is wrapped around the securing-strap-receiving portion 410.

Figure 7A:
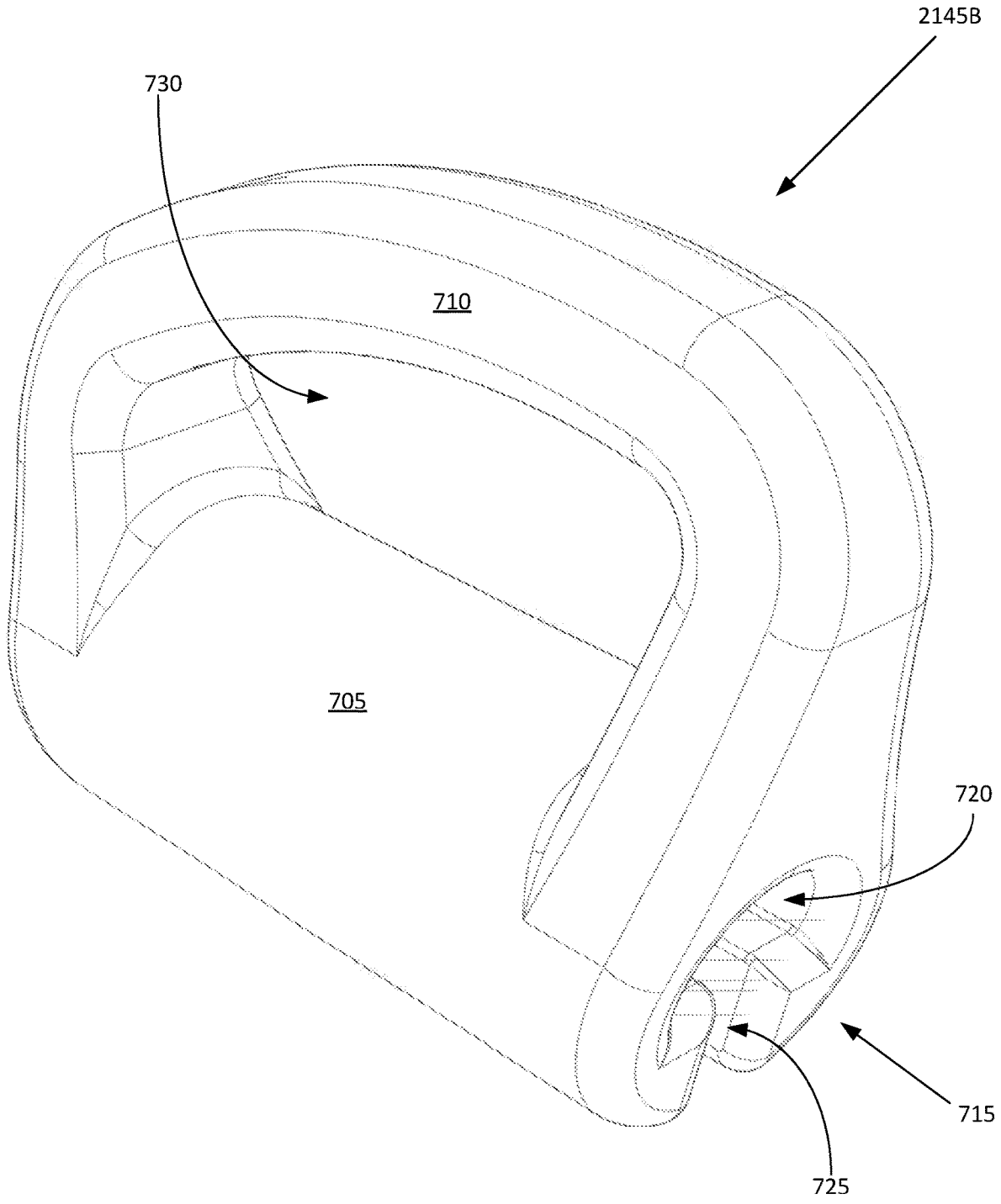
FIG. 7A illustrates a perspective view of a second embodiment of the second carriage member illustrated in FIGS. 1A and 1B.
Figure 7B:
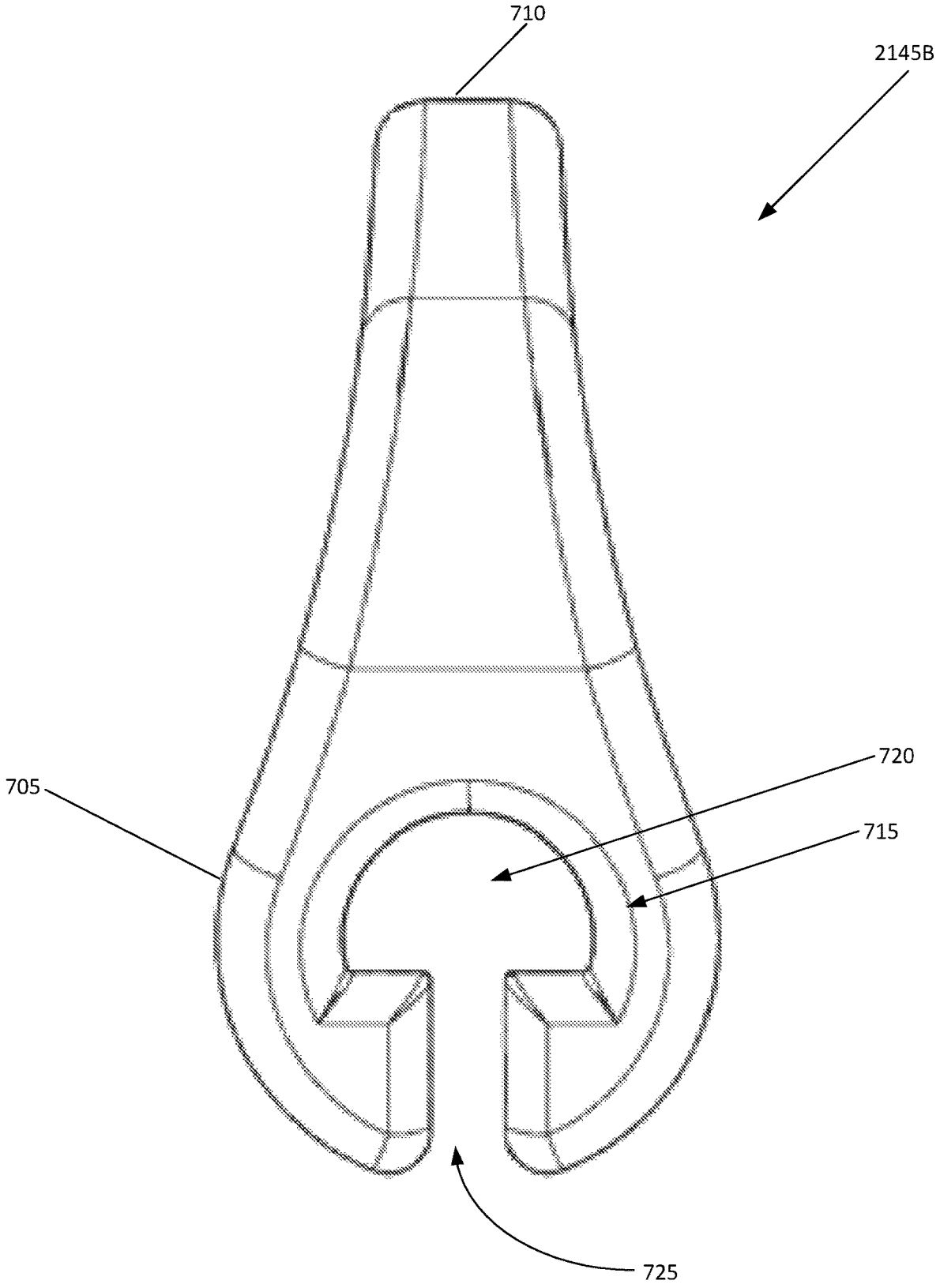
FIG. 7B illustrates an end view of the second embodiment of the second carriage member illustrated in FIG. 7A.

As illustrated in the embodiment of FIGS. 7A and 7B, another embodiment of the second carriage member 2145B also includes a guide-element-receiving portion 705 and securing-strap-receiving portion 710. The embodiment of the second carriage member 2145B illustrated in FIGS. 7A and 7B is configured to slidingly couple to the embodiment of the guide element 2140 illustrated in FIG. 5, where the guide-element-receiving portion 705 slidingly couples the second carriage member 2145B to the guide element 2140. In the illustrated embodiment, the guide-element-receiving portion 705 defines an aperture 715 with a half cylindrical portion 720 and a slot portion 725. The half cylindrical portion 720 is configured to receive the guide portion 500 of the guide element 2140 of FIG. 5, while the slot portion 725 is configured to receive the planar portion 505 of the guide element 2140 of FIG. 5. Because the guide portion 500 of the guide element 2140 is wider than the planar portion 505 of the guide element 2140 and the slot portion 725 of the guide-element-receiving portion 705, the second carriage member 2145B is configured to slide along the guide element 2140 without being pulled from the guide element 2140. In addition, the guide-element-receiving portion 705 is sized to hold the second carriage member 2145B in a desired position along the embodiment of the guide element 2140 illustrated in FIG. 5 (via friction) but permit movement of the second carriage member 2145B when sufficient force is applied thereto. In other words, the half cylindrical portion 720 and the slot portion 725 of the aperture 715 are sized and shaped to frictionally slide along the guide element 2140.

Similar to the embodiment of the second carriage member 145B illustrated in FIGS. 4A and 4B, the securing-strap-receiving portion 710 of the second carriage member 2145B illustrated in FIGS. 7A and 7B is formed as an arched member or bar spaced from the guide-element-receiving portion 705 such that the securing-strap-receiving portion 710 and the guide-element-receiving portion 705 collectively form an opening 720. A securing strap 175 may pass through the opening 720 such that the end of the securing strap 175 is wrapped around the securing-strap-receiving portion 710.

Each guide element 140, 1140, 2140 may also include stops 160 disposed at selected locations along the length of the travel path. Each stop 160 is designed or configured to prevent movement of the carriage members (e.g., members 145A, 145B) on and along the guide rail beyond the stop location. In certain embodiments, the stop 160 may be in the form of webbing 150 that secures the guide element to the upper 105. In other embodiments, the stops 160 may be rings (e.g., plastic rings) or other devices mounted onto the guide element. The stops 160 may be fixed in position, or may be selectively moveable to enable adjustment of the stop locations along the guide element.

The medial guide elements can further include one or more stop members or stops to inhibit or prevent further movement in at least one direction of carriage members along the guide element. As illustrated in FIGS. 1A and 1B, the medial guide element 140A and the lateral guide element 140B each include a single stop 160. The stop 160 of the medial guide element 140A is disposed between the plurality of first carriage members 145A and the second carriage member 145B. The stop 160 is disposed on the medial guide element 140A closer to the rearmost end of the medial guide element 140A than the foremost end of the medial guide element 140A. Similarly, the stop 160 of the lateral guide element 140B is disposed between the plurality of first carriage members 145A and the second carriage member 145B. The stop 160 is disposed on the lateral guide element 140B closer to the rearmost end of the lateral guide element 140B than the foremost end of the lateral guide element 140B. Thus, the plurality of first carriage members 145A are configured to move along their respective guide elements 140A, 140B between a respective stop 160 and the foremost end of each guide element 140A, 140B, while the second carriage members 145B are configured to move along their respective guide elements 140A, 140B between a respective stop 160 and the rearmost end of each guide element 140A, 140B.

In alternative embodiments, a plurality of stops can be located along a guide element at one or both of the medial and lateral sides. For example, in the embodiment illustrated in FIG. 2, a plurality of stops 160 are disposed along the guide element 1140. Because guide element 1140 of FIG. 2 spans both sides and around the heel cup of the shoe 100, the guide element 1140 includes additional stops proximate the rear end of the shoe 100. This prevents the rearmost carriage member 145A on the medial and lateral sides 130, 135 from sliding around the heel of the shoe 100.

As already described herein, the lacing element 170 is configured to pass through lacing element receiving portions of the carriage members. For example, referring to FIGS. 1A and 1B, the lacing element 170 is configured to pass through the lacing element receiving portions 310, 610 of the first carriage members 145A and to work in concert with the guide element 140 and first carriage members 145A to secure the foot within the article of footwear 100 (e.g., by cinching the upper 105 against the foot of the wearer). The lacing element 170 is flexible, possessing tensile strength sufficient for its described purpose (to capture a lace and secure a shoe to a user's foot). The lacing element 170 may be a strand, which includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.). In an embodiment, a strand is a yarn (a continuous strand of textile fibers, filaments, or material in a form suitable for knitting, weaving, or otherwise intertwining to form a textile fabric). A yarn may include, but is not limited to, a number of fibers twisted together (spun yarn), a number of filaments laid together without twist (a zero-twist yarn), a number of filaments laid together with a degree of twist, and a single filament with or without twist (a monofilament). By way of specific example, the carrier strand may be a nylon cord, a polyester cord, or a cord formed of high molecular weight polyolefin (e.g., polyethylene). In still other embodiments, the strand is a cable formed of, e.g., metal such as steel. The carrier strand may further include multiple strands (e.g., multiple lines, cables, or cords).

The lacing element 170 may further be an open cord, having two distinct ends (e.g., a conventional shoe lace) or may be closed cord, having no ends (i.e., the cord is continuous, encircling strip (e.g., a band or belt)). In addition, the lacing element 170 may be manually tightened, or may be tightened via an actuator manipulated by the wearer (e.g., a BOA dial).

Operation of the dynamic tensioning system is described with reference to the example embodiment of FIGS. 1A and 1B. In operation, the lacing element 170 is fed through aperture 320 of the first carriage members 145A on the medial and lateral sides 130, 135 of the shoe such that the lacing element 170 extends over the upper 105 of the shoe 100 in the midfoot region 120B. A user may insert a foot into the cavity formed by the upper 105 and the sole structure 110 of the shoe 100. In one embodiment, the user may position each of the first carriage members 145A along the guide element 140 to suitable locations (i.e., positions that enable the shoe 100 to be most comfortable or most supportive to the user's foot placed within the shoe 100 when the user tightens the lacing element 170). In another embodiment, the first carriage members 145A may be configured to enable the user of the shoe 100 to pull on the ends of the lacing element 170, causing the lacing element 170 to be pulled through the lacing-element-receiving portion 310, 610 of the first carriage members 145A, which further results in the first carriage members 145A being repositioned along the guide element 140 by sliding along the guide element 140. In this embodiment, the pulling of the ends of the lacing element 170 enables the lacing element 170 and the first carriage members 145A to be placed into positions that generally align with the contours of the foot placed within the shoe 100.

In the embodiment illustrated in FIGS. 1A and 1B, the securing strap 175 may extend from the second carriage member 145B on the medial side 130 of the shoe 100, across the heel, and to the second carriage member 145B on the lateral side 135 of the shoe 100. Each end of the securing strap 175 may be tethered to the securing-strap-receiving portion 410, 710 of the second carriage members 145B. Furthermore, the securing strap 175 may be flexible and resilient, where, in operation, the second carriage members 145B are positioned along the guide element 140 such that the securing strap 175 stretches around the heel end of the shoe 100. The resiliency of the securing strap 175 secures or retains the heel of a foot within the shoe 100. In certain embodiments, the securing strap 175 can function as a heel counter to provide further support for the upper and the user's foot at the rear or heel end of the shoe.

Thus, the dynamic tensioning system for an article of footwear or shoe provides an adjustable tensioning feature for the shoe to selectively control tightening or loosening of the upper against the foot of a wearer at different locations along medial and lateral sides and/or along the heel portion based upon positioning of carriage members along guide elements of the shoe. The adjustable features of the dynamic tensioning system can also be combined with features of the upper itself based upon materials and/or processes used to form the upper.

For example, in certain embodiments, the upper 105 (or one or more sections of the upper) can comprise a textile formed via knitting. Knitting is a process for constructing fabric by interlocking a series of loops (bights) of one or more strands organized in wales and courses. In general, knitting includes warp knitting and weft knitting. In warp knitting, a plurality of strands runs lengthwise in the fabric to make all the loops.

In weft knitting, one continuous strand runs crosswise in the fabric, making all of the loops in one course. Weft knitting includes fabrics formed on both circular knitting and flat knitting machines. With circular knitting machines, the fabric is produced in the form of a tube, with the strands running continuously around the fabric. With a flat knitting machine, the fabric is produced in flat form, the threads alternating back and forth across the fabric. In an embodiment, the upper 105 can be formed via flat knitting utilizing stitches including, but not limited to, a plain stitch; a rib stitch, a purl stitch; a missed or float stitch (to produce a float of yarn on the fabric's wrong side); and a tuck stitch (to create an open space in the fabric). The resulting textile includes an interior side (the technical back) and an exterior side (the technical face), each layer being formed of the same or varying strands and/or stitches. By way of example, the textile may be a single knit/jersey fabric, a double knit/jersey fabric, and/or a plated fabric (with yarns of different properties are disposed on the face and back). In a specific embodiment, the upper textile is a double knit fabric formed via a flat knitting process.

Utilizing knitting, the entire upper 105 (or selected sections) may be configured as a unitary structure (i.e., it may possess a unibody construction) to minimize the number of seams utilized to form the shape of the upper. For example, the upper 105 may be formed as a one-piece template, each template portion being integral with adjacent template portions. Accordingly, each section of the upper 105 may include a common strand interconnecting that section with adjacent sections (i.e., the common strand spans both sections). In addition, the connection between adjacent sections may be stitchless and seamless. By stitchless and/or seamless, it is meant that adjacent sections are continuous or integral with each other, including no edges that require joining by stitches, tape, adhesive, welding (fusing), etc.

The strands forming the knitted textile (and thus the upper 105) may be any natural or synthetic strands suitable for their described purpose (i.e., to form a knit upper). The term "strand" for the upper includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strands may be heat sensitive strands such as flowable (fusible) strands and softening strands. Flowable strands include polymers that possess a melting and/or glass transition point at which the solid polymer liquefies, generating viscous flow (i.e., becomes molten). In an embodiment, the melting and/or glass transition point of the flowable polymer may be approximately 80° C. to about 150° C. (e.g., 85° C.). Examples of flowable strands include thermoplastic materials such as polyurethanes (i.e., thermoplastic polyurethane or TPU), ethylene vinyl acetates, polyamides (e.g., low melt nylons), and polyesters (e.g., low melt polyester). Preferred examples of melting strands include TPU and polyester. As a strand becomes flowable, it surrounds adjacent strands. Upon cooling, the strands form a rigid interconnected structure that strengthens the textile and/or limits the movement of adjacent strands.

Softening strands are polymeric strands that possess a softening point (the temperature at which a material softens beyond some arbitrary softness). Many thermoplastic polymers do not have a defined point that marks the transition from solid to fluid. Instead, they become softer as temperature increases. The softening point is measured via the Vicat method (ISO 306 and ASTM D 1525), or via heat deflection test (HDT) (ISO 75 and ASTM D 648). In an embodiment, the softening point of the strand is from approximately 60° C. to approximately 90° C. When softened, the strands become tacky, adhering to adjacent stands. Once cooled, movement of the textile strands is restricted (i.e., the textile at that location stiffens).

One additional type of heat sensitive strand which may be utilized is a thermosetting strand. Thermosetting strands are generally flexible under ambient conditions, but become irreversibly inflexible upon heating.

The strands may also include heat insensitive strands. Heat insensitive strands are not sensitive to the processing temperatures experienced by the upper (e.g., during formation and/or use). Accordingly, heat insensitive strands possess a softening, glass transition, or melting point value greater than that of any softening or melting strands present in the textile structure and/or greater than the temperature ranges specified above.

The upper 105 can further include a strand formed of non-elastomeric material, i.e., an inelastic strand. In conventional uppers, elastic strands are utilized to provide a textile upper with stretch and recovery properties. An elastic strand is formed of elastomeric material (e.g., rubber or a synthetic polymer having properties of rubber). Accordingly, an elastic strand possesses the ability to stretch and recover by virtue of its composition. A specific example of an elastomeric material suitable for forming an elastic strand is an elastomeric polyester-polyurethane copolymer such as elastane, which is a manufactured fiber in which the fiber-forming substance is a long chain synthetic polymer composed of at least 85% of segmented polyurethane.

The degree to which fibers, yarn, or cord returns to its original size and shape after deformation indicates how well a fabric/textile recovers. Even when utilized, the upper does not quickly recover to its original size and shape. Sagging will develop within the upper over time, caused by the incomplete recovery within the structure. An elastic strand such as elastane, moreover, retains water, potentially creating wearer discomfort. In addition, elastane must be braided onto an existing yarn or completely covered by another fiber, increasing the weight of the textile (i.e., it cannot be the sole component of a course within the knit structure).

In contrast, an inelastic strand is formed of a non-elastomeric material. Accordingly, by virtue of its composition, inelastic strands possess no inherent stretch and/or recovery properties. Hard yarns are examples of inelastic strands. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly(ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof.

The upper 105 can include an inelastic strand possessing a topology that enables it to provide mechanical stretch and recovery within the knit structure. In an embodiment, the inelastic strand is a hard yarn texturized to generate stretch within the yarn. In a preferred embodiment, the inelastic strand is a bicomponent strand formed of two polymer components, each component possessing differing properties. The components may be organized in a sheath-core structure. Alternatively, the components—also called segments—may be oriented in a side-by-side (bilateral) relationship, being connected along the length of the strand.

By way of example, a strand may be a polyester bicomponent strand. A polyester bicomponent strand is a continuous filament having a pair of polyesters connected side-by-side, along the length of the filament. Specifically, the polyester bicomponent strand may include a poly(trimethylene terephthalate) and at least one polymer selected from the group consisting of poly(ethylene terephthalate), poly (trimethylene terephthalate), and poly(tetramethylene terephthalate) or a combination thereof. By way of example, the polyester bicomponent filaments include poly(ethylene terephthalate) and poly(trimethylene terephthalate) in a weight ratio of about 30/70 to about 70/30. In a preferred embodiment, the first polyester component is a 2GT type polyester polyethylene terephthalate (PET) and the second polyester component is a 3GT type polyester (e.g., polytrimethylene terephthalate (PTT)). In an embodiment, the 2GT type polyester forms about 60 wt % of the strand, while the 3GT type polyester forms about 40 wt % of the strand. As noted above, the strand may be in the form of, without limitation, a single filament or a collection of filaments twisted into a yarn.

Additionally, various co-monomers can be incorporated into the polyesters of the bicomponent strand in minor amounts, provided such co-monomers do not have an adverse effect on the amount of strand coiling. Examples include linear, cyclic, and branched aliphatic dicarboxylic acids (and their diesters) having 4-12 carbon atoms; aromatic dicarboxylic acids (and their esters) having 8-12 carbon atoms (for example isophthalic acid, 2,6-naphthalenedicarboxylic acid, and 5-sodium-sulfoisophthalic acid); and linear, cyclic, and branched aliphatic diols having 3-8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol), isophthalic acid, pentanedioic acid, 5-sodium-sulfoisophthalic acid, hexanedioic acid, 1,3-propane diol, and 1,4-butanediol are preferred. The polyesters can also contain additives, such as titanium dioxide.

With the above configuration, when exposed to heat, the first polymer (polyester) component shrinks/contracts at a different rate than the second polymer (polyester) component. This, in turn, produces a regular, helical coil along the length of the strand. In an embodiment, the contraction value of each polymer segment may range from about 10% to about 80% (from its original diameter). The strand may possess an after-heat-set crimp contraction value from about 30% to about 60%.

The helical coil of the strand generates non-elastomeric, mechanical stretch and recovery properties within the strand (e.g., the filament or yarn). That is, the strand possesses mechanical stretch and recovery without the need to texturize the strand, which reduces strand durability. A bicomponent strand, moreover, possesses increased recovery properties compared to elastic strands at stretch levels of less than 25%. The recovery power of elastic strands increases with increasing stretch (e.g., 100% or more). Stated another way, the further an elastic strand is stretched, the better it recovers. At low stretch levels, elastic strands generate low recovery power. This is a disadvantage in footwear uppers, where the amount of stretch required during use is minimal (e.g., less than 25%).

The bicomponent strand may possess any dimensions suitable for its described purpose. By way of example, the bicomponent strands may be present within the textile as yarn having a denier of from about 70 denier to about 900 denier (78 dtex to 1000 dtex) and, in particular, from about 100 denier to about 450 denier.

In another embodiment, the one or more sections of the upper can be thermoformed. By way of further example, the upper 105 can be formed of fabric laminate that is capable of being shaped via compression molding. By way of still further example, the upper 105 is formed of a fabric lamination including a foam layer. Compression molding is a method of molding in which the molding material is first placed in an open, heated mold cavity. The mold is closed with a top force or plug member, pressure is applied to force the material into contact with all mold areas, while heat and pressure are maintained until the molding material has cured. A compression molding apparatus may include a first or female molding portion configured to receive a second or male molding portion possessing a shape complementary to the shape of the first molding portion. The apparatus may be utilized to shape a single layer, or may be utilized to shape a multilayered structure. The formed upper 105 includes three or more layers—one or more outer layers, one or more intermediate layers, and one or more inner layers. By way of example, the outer layer may be a breathable, synthetic fabric (e.g., a polyester fabric), the intermediate layer may be open-celled foam (e.g., ethylene vinylacetate), and the inner layer may be a breathable, synthetic fabric (e.g., a polyester fabric).

Upon compression (and the application of heat), the layers adhere, forming a fabric laminate. Additionally, the fabric laminate conforms to the shape of the molding portions, with the laminate permanently holding its shape. This formation process enables the creation of the macrostructure of the upper 105 (the overall shape of the component), but also the microstructure of the upper. With regard to the macrostructure, the heel cup may be formed such that it is seamless. Conventional footwear typically includes a seam (e.g., a welded seam or a stitched seam) within the heel cup. For example, a conventional heel cup includes a vertical seam along the connection between two heel halves (lateral and medial halves) and a longitudinal seam along the connection between the two halves of the footpad. The heel of the article of footwear 100 discussed herein, in contrast, does not include a seam. Instead, the heel is a unitary structure shaped to define a seamless, unitary heel cup.

The microstructure may further include protrusions, e.g., generally rounded nubs or bosses extending outward from either the interior surface or the exterior surface of the upper. When extending from the exterior surface of the upper, the protrusions may provide abrasion resistance or impact protection in specified areas of the upper. In addition, the protrusions may define contact areas configured to improve contact with a ball during game play (e.g., a soccer ball, kickball, etc.).

Thus, the upper can be formed with a combination of different materials and/or via different techniques (e.g., knitting, thermoforming and combinations thereof) that impart certain properties to the upper which, in combination with the dynamic tensioning system, can enhance the fit, comfort and/or feel of the upper against the foot of the wearer as well as enhancing the performance of the shoe for the wearer for particular applications. In an example embodiment (e.g., as depicted in FIGS. 1A and 1B), the upper can include one or more portions disposed above the guide members that comprise a different material and/or are formed via a different process in relation to one or more portions of the upper disposed below the guide members.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

For example, any number of carriage members 145 and/or stops 160 may be positioned along the guide element 140 (i.e., any number may be positioned on each of the lateral and medial side). In addition, various features from one of the embodiments may be incorporated into another of the embodiments.

The upper can be formed of any variety of different materials and/or utilizing any one or more different types of processes as described herein and depending upon a particular application.

Accordingly, it is appropriate that the appended claims be construed broadly and in a manner consistent with the scope of the disclosure as set forth in the following claims.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

What is claimed:

1. An article of footwear comprising:

a sole;

an upper coupled to the sole, the upper being configured to receive at least a portion of a human foot;

a guide rail disposed on and secured directly with the upper that extends continuously between a lateral side and a medial side of the upper; and a carriage member coupled to the guide rail while being free of any direct connection with the upper such that the carriage member is adapted to move along the guide rail, wherein the carriage member comprises a proximal, guide-element-receiving portion configured to slidingly couple the carriage member to the guide rail, and a distal fastening-element-receiving portion adapted to receive and retain a section of a fastening element of the upper so as to couple the carriage member with the fastening element.

2. The article of footwear of claim 1, wherein the guide rail extends continuously around a heel end of the upper between the lateral side and the medial side of the upper.

3. The article of footwear of claim 1, further comprising a plurality of carriage members, each carriage member of the plurality of carriage members being movably coupled to the guide rail such that each carriage member is adapted to move independently of any other carriage member of the plurality of carriage members, each carriage member traveling along a lengthwise portion of the guide rail.

4. The article of footwear of claim 1, wherein the fastening element comprises a lacing element that extends between the lateral side and the medial side of the upper.

5. The article of footwear of claim 1, wherein the fastening element comprises a securing strap that extends around a heel end of the upper and connects at an end of the securing strap to the fastening-element-receiving portion of the carriage member.

6. The article of footwear of claim 1, wherein at least one end of the guide rail extends from the sole.

7. The article of footwear of claim 1, wherein the guide-rail-receiving portion comprises a semicircular clip mounted on the guide rail to facilitate sliding movement of the carriage member along the guide rail, and the fastening-element-receiving portion includes an aperture configured to receive a portion of the fastening element and facilitate passage of the fastening element through the aperture.

8. The article of footwear of claim 7, wherein the guide rail and the guide-rail-receiving portion of the carriage member cooperate such that the carriage member is retained by a frictional force that maintains the carriage member at a selected position along the guard rail until a sufficient force is applied to the carriage member to overcome the frictional force so as to move the carriage member along the guide rail.

9. The article of footwear of claim 1, wherein the article of footwear includes a forefoot region, a hindfoot region, and a midfoot region disposed between the forefoot region and hindfoot region, and the carriage member is configured to slide along the guide rail in the midfoot region or the hindfoot region.

10. The article of footwear of claim 1, further comprising a plurality of carriage members coupled with the guide rail, wherein the upper includes an opening defined by a collar of the upper that facilitates receipt of at least a portion of the human foot, the guide rail is secured directly with the upper so as to extend entirely below the collar of the upper, and every carriage member coupled with the guide rail is located entirely below the collar of the upper.

11. An article of footwear comprising:

a sole structure;

an upper coupled to the sole structure, the upper being configured to receive at least a portion of a human foot at an opening defined by a collar of the upper;

a medial guide rail disposed on a medial side of the upper and extending entirely below the collar of the upper;

a lateral guide rail disposed on a lateral side of the upper and extending entirely below the collar of the upper, wherein the medial and lateral guide rails connect with each other as a single continuously extending guide rail that extends from the medial and lateral sides of the upper and around a heel end of the upper;

a plurality of medial carriage members, wherein each medial carriage member is movably coupled to the medial guide rail such that each medial carriage member is adapted to move along the medial guide rail, and every medial carriage member coupled with the medial guide rail is located entirely below the collar of the upper;

a plurality of lateral carriage members, wherein each lateral carriage member is movably coupled to the lateral guide rail such that each lateral carriage member is adapted to move along the lateral guide rail, and every lateral carriage member coupled with the lateral guide rail is located entirely below the collar of the upper; and a fastening element coupled to at least one of the medial carriage members and at least one of the lateral carriage members across the upper.

12. The article of footwear of claim 11, wherein the fastening element comprises a lacing element that extends between the lateral side and the medial side of the upper.

13. The article of footwear of claim 12, wherein the lacing element is coupled to each medial carriage member and each lateral carriage member as the lacing element extends between the lateral side and the medial side of the upper.

14. The article of footwear of claim 11, wherein at least one end of one or both of the medial and lateral guide rails extends from the sole.

15. The article of footwear of claim 11, wherein the article of footwear includes a forefoot region, a hindfoot region, and a midfoot region disposed between the forefoot region and hindfoot region, the medial guide rail extends along the medial side of the upper through the midfoot region and the hindfoot region, and the lateral guide rail extends along the lateral side of the upper through the midfoot region and the hindfoot region.

16. The article of footwear of claim 15, further comprising:

a medial stop member disposed on the medial guide rail proximate a transition from the hindfoot region to the midfoot region; and a lateral stop member disposed on the lateral guide rail proximate a transition from the hindfoot region to the midfoot region;

wherein the medial stop member is configured to prevent each medial carriage member from moving along the medial guide rail past the medial stop member, and the lateral stop member is configured to prevent each lateral carriage member from moving along the lateral guide rail past the lateral stop member.

17. The article of footwear of claim 16, wherein each medial carriage member is configured to move along the medial guide rail between the medial stop member and a forward end of the medial guide rail, and each lateral carriage member is configured to move along the lateral guide rail between the lateral stop member and a forward end of the lateral guide rail.

18. The article of footwear of claim 11, wherein each of the medial and lateral guide rails and each carriage member cooperate such that each carriage member is retained by a frictional force that maintains the carriage member at a selected position along a respective guard rail until a sufficient force is applied to the carriage member to overcome the frictional force so as to move the carriage member along the guide rail.

19. The article of footwear of claim 11, wherein:

the medial guide rail is secured directly with the upper, and the medial carriage member is secured directly with the medial guide rail while being free of any direct connection with the upper; and the lateral guide rail is secured directly with the upper, and the lateral carriage member is secured directly with the lateral guide rail while being free of any direct connection with the upper.

* * * * *